US005893433A

United States Patent [19]

Koura

[11] Patent Number: 5,893,433

[45] Date of Patent: Apr. 13, 1999

[54] ELEVATOR CAR POSITION DETECTING APPARATUS

[75] Inventor: Kunikazu Koura, Inazawa, Japan

[73] Assignee: Mitsubishi Denki Kabushiki Kaisha, Tokyo, Japan

[21] Appl. No.: 08/070,863

[22] Filed: Jun. 3, 1993

[30] Foreign Application Priority Data

Jun. 4, 1992 [JP] Japan ..... 4-144164

[51] Int. Cl.[6] ..... B66B 1/34

[52] U.S. Cl. ..... 187/394; 187/282; 187/283; 187/284

[58] Field of Search ..... 187/134, 135, 187/129, 105, 282, 283, 284, 394

[56] References Cited

U.S. PATENT DOCUMENTS

| | | | |
|---|---|---|---|
| 2,938,603 | 5/1960 | Loughridge | 187/134 |
| 3,261,427 | 7/1966 | Morris | 187/134 |
| 3,983,961 | 10/1976 | Aron | 187/29 R |
| 4,433,756 | 2/1984 | Caputo et al. | 187/134 |
| 5,135,081 | 8/1992 | Watt et al. | 187/134 |
| 5,247,139 | 9/1993 | Schon et al. | 187/104 |

FOREIGN PATENT DOCUMENTS

| | | | |
|---|---|---|---|
| 245757 | 3/1966 | Germany | 187/134 |
| 62-280174 | 12/1987 | Japan . | |
| 2166711 | 5/1986 | United Kingdom . | |

*Primary Examiner*—Robert E. Nappi
*Attorney, Agent, or Firm*—Leydig, Voit & Mayer

[57] ABSTRACT

An elevator car position detecting apparatus includes plates arranged at selected operation points defined along the elevator path, in such arrangement that one operation point is distinguishable from another operation point. Position detectors are provided on a car so that as car moves past the operation points the position detectors communicate with corresponding plates without contacting the plates. The position detectors associated with the corresponding plates generate signals indicating that the elevator car has reached the corresponding position.

3 Claims, 4 Drawing Sheets

ELEVATOR CAR POSITION DETECTING APPARATUS

BACKGROUND OF THE INVENTION

1. Field of the Invention

The present invention relates to an elevator car position detecting apparatus for detecting the position of an elevator car when the car is near one of the ends of the path of the elevator.

2. Description of the Prior Art

Japanese Patent Application Laid-open No. 62-280174 describes an elevator car position detecting apparatus as illustrated in FIG. 4. Referring to the figure, arms 2*a* to 2*e* are horizontally projected from a wall 1 of the path along which an elevator car 6 is moved up and down. The arms 2*a* to 2*e* are arranged vertically in order of length. More specifically, the lowest arm 2*a* is the shortest, and the uppermost arm 2*e* is the longest. A cam 3 is fixed to the end portions of the arms 2*a* to 2*e* and has inclined portions 3*a* to 3*d*. A switch 5 is attached to the car 6.

The switch 5 comprises: a roller 50 which is associated with the cam 3 as the car 6 ascends; a lever 51 which turns about a fulcrum 52 when the roller 50 is associated with the cam 3; springs 52*a* and 52*b* connected to a lower portion of the lever 51 so as to maintain the lower portion of the lever substantially in the vertical posture when the roller 50 does not receive an external force; and switch box 54 containing switches (described below) which are operated as the lever 51 turns.

Components contained in the switch box 54 will be described with reference to FIG. 5. The lever 51 is connected at the lower end to a horizontal bar 53. Contacts 51*a* to 51*d* are connected to the horizontal bar 53. A contact 54*a* faces the contact 51*a*, spaced from the contact 51*a* by an air gap g1. Similarly, contacts 51*b* to 54*d* face the contacts 53*b* to 53*d*, spaced by air gaps g2 to g4, respectively. The size relation of the air gaps g1 to g4 are:

$$g1<g2<g3<g4$$

The four pairs of contacts, 51*a* and 54*a* to 51*d* and 54*d*, form four separate switches 55*a* to 55*d*.

The operation of the above-described conventional elevator car position detecting apparatus will be described.

When the car 6 is far from the top end of the path and therefore the roller 50 is not associated with the cam 3, the lever 51 assumes a vertical posture (as shown in FIG. 5) and all the switches 55*a* to 55*d* are off. When the roller 50 becomes associated with the inclined portion 3*a* of the cam 3 as the car 6 ascends, the lever 51 turns in the direction indicated by the arrow R in FIG. 5 and thus connects the switch 55*a*. The switch-on signal thus generated is sent to a control unit (not shown), thus informing that the car has reached the inclined portion 3*a*. As the car 6 further ascends so that the roller 3*a* is associated with the inclined portion 3*b*, the lever 51 further turns in the direction indicated by the arrow R, thus connecting the switch 55*b*. In the same manner, as the roller 50 becomes associated sequentially with the inclined portions 3*c* and 3*d*, the lever 51 further turns to sequentially connect the switches 55*c* and 55*d*. In this manner, the switch-on signals generated by the switches 55*a* to 55*d* inform the control unit that the car 6 has reached the corresponding positions.

Then, as the car 6 descends from the top position, the switch 55*d* is first disconnected, and the switch 55*a* is last disconnected. The control unit thus monitors the position of the car 6.

Although the above description has been made with reference to the case where the car 6 is near the top terminal floor, it will be easily understood, without further description, that the position of the car 6 can be monitored in a similar manner when the car 6 is near the bottom terminal floor.

The above Japanese Patent Application Laid-open No. 62-280174 also describes a position detecting apparatus comprising: a detector which is attached to an elevator car and has a light emitter and a light receiver; and a stepped light-shielding plate which is attached to the path of the elevator car and insertable into a gap between the light emitter and the light receiver without contacting either the light emitter or receiver. The patent application further states that such a position detecting apparatus can also be achieved by utilizing magnetism, for example, employing a magnetism-shielding plate instead of the light-shielding plate.

However, because the above-described conventional detecting apparatuses employing cams connected to the paths of the elevator cars detect the position of an elevator car on the basis of the positions of the inclined portions of the cam, the size of the gap between the elevator car and the wall of the path significantly affects the precision of the position detection, thus requiring precise installation and adjustment of the elevator, which is not easy. Even if precise installation and adjustment is achieved, the gap size varies as the elevator is used. In several years, the detection precision deteriorates to such a level that re-adjustment is required. Further, the conventional apparatus produces noise when the roller contacts the cam. The noise problems can be eliminated by a non-contact position detecting apparatus. However, both the contact and non-contact types require as many cam surfaces or shielding plates as the positions to be detected, and as many detection elements, e.g., switches. To increase the number of positions to be detected, the number of these components must be proportionally increased.

SUMMARY OF THE INVENTION

Accordingly, an object of the present invention is to provide an elevator car position detecting apparatus which achieves accurate and precise detection, facilitates installation of the apparatus and the elevator, achieves quiet operation, and requires fewer detection elements than the positions to be detected.

To achieve the above objects, according to one aspect of the present invention, there is provided an elevator car position detecting apparatus comprising: a plurality of plates provided at each of operation points in such arrangement that one operation point is distinguishable from another operation point; and a position detector which is provided on a car and which is associable with the corresponding plates without contacting the plates and generates a signal indicating that the car has reached one of the operation points when associated with one of the plates.

In the above elevator car position detecting apparatus, each operation point is encoded by the plates provided at the operation point in such arrangement that one operation point is distinguishable from another operation point, and a detection signal is generated by a position detector when it is associated with a plate. The apparatus thus determines that the elevator car has reached an operation point on the basis of a detection signal.

DESCRIPTION OF THE PREFERRED EMBODIMENT

Figure 1:
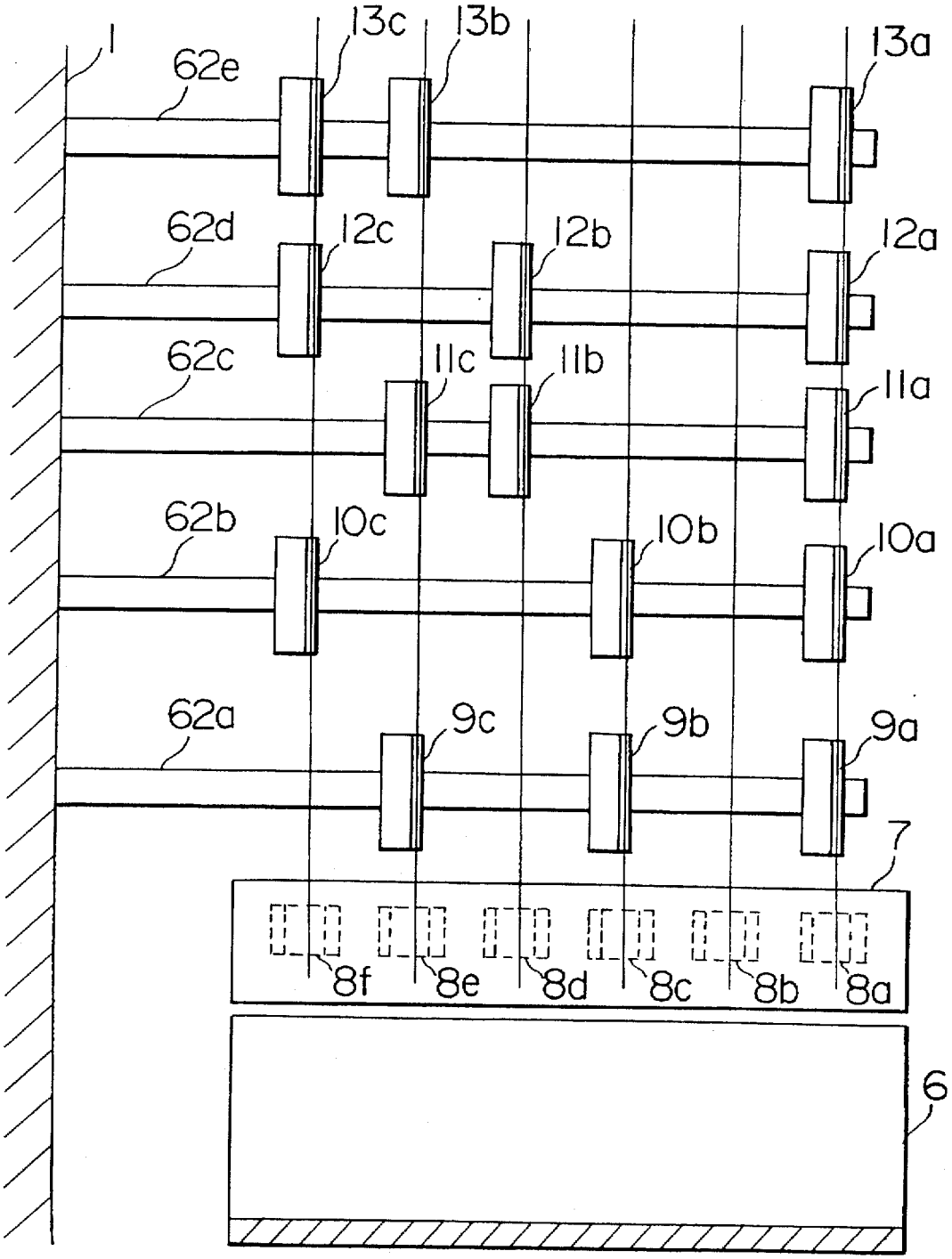
FIG. 1 is a front elevation of an elevator car position detecting apparatus according to an embodiment of the present invention.
Figure 4:
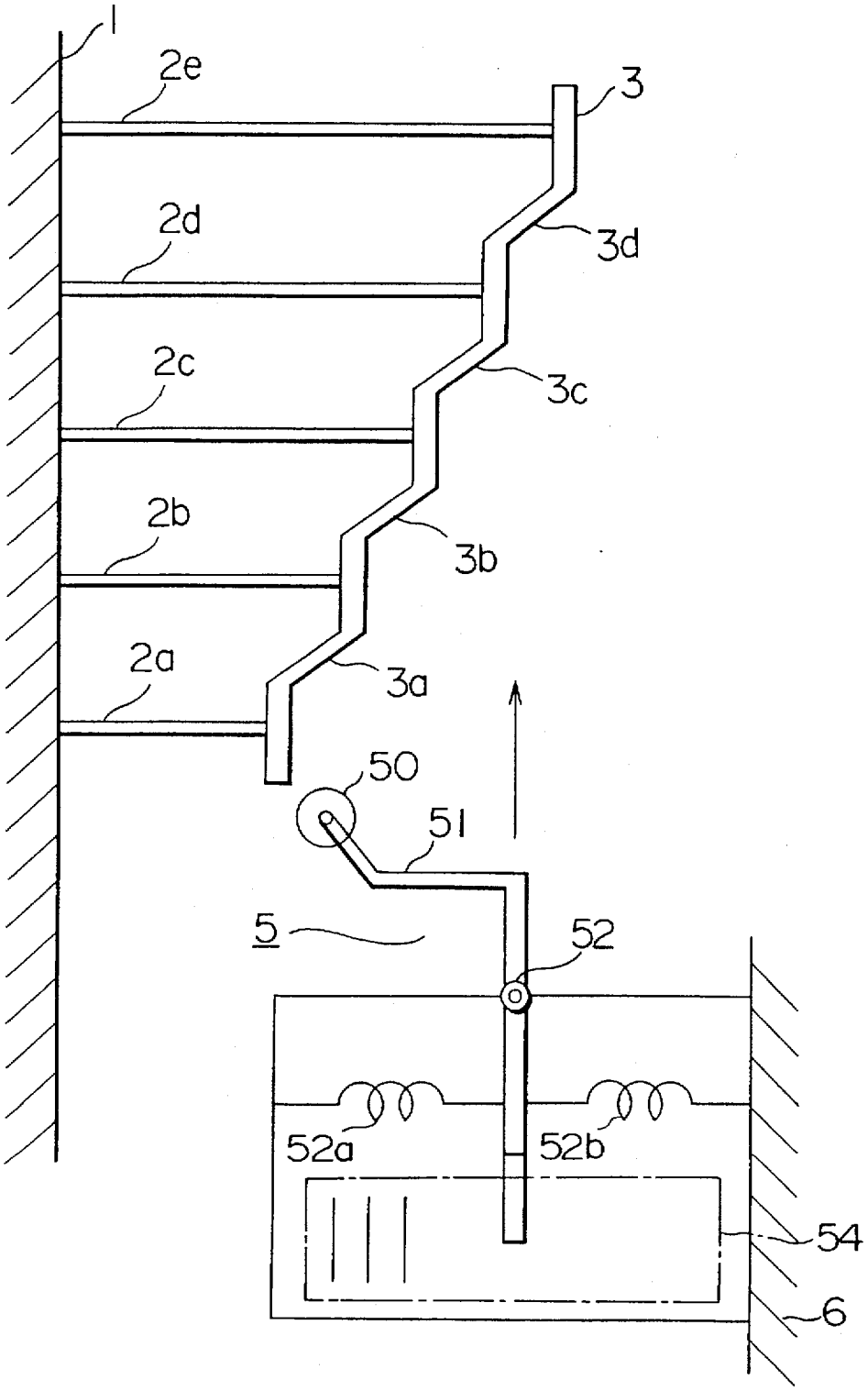
FIG. 4 is a schematic front elevation of a conventional elevator car position detecting apparatus.
Figure 5:
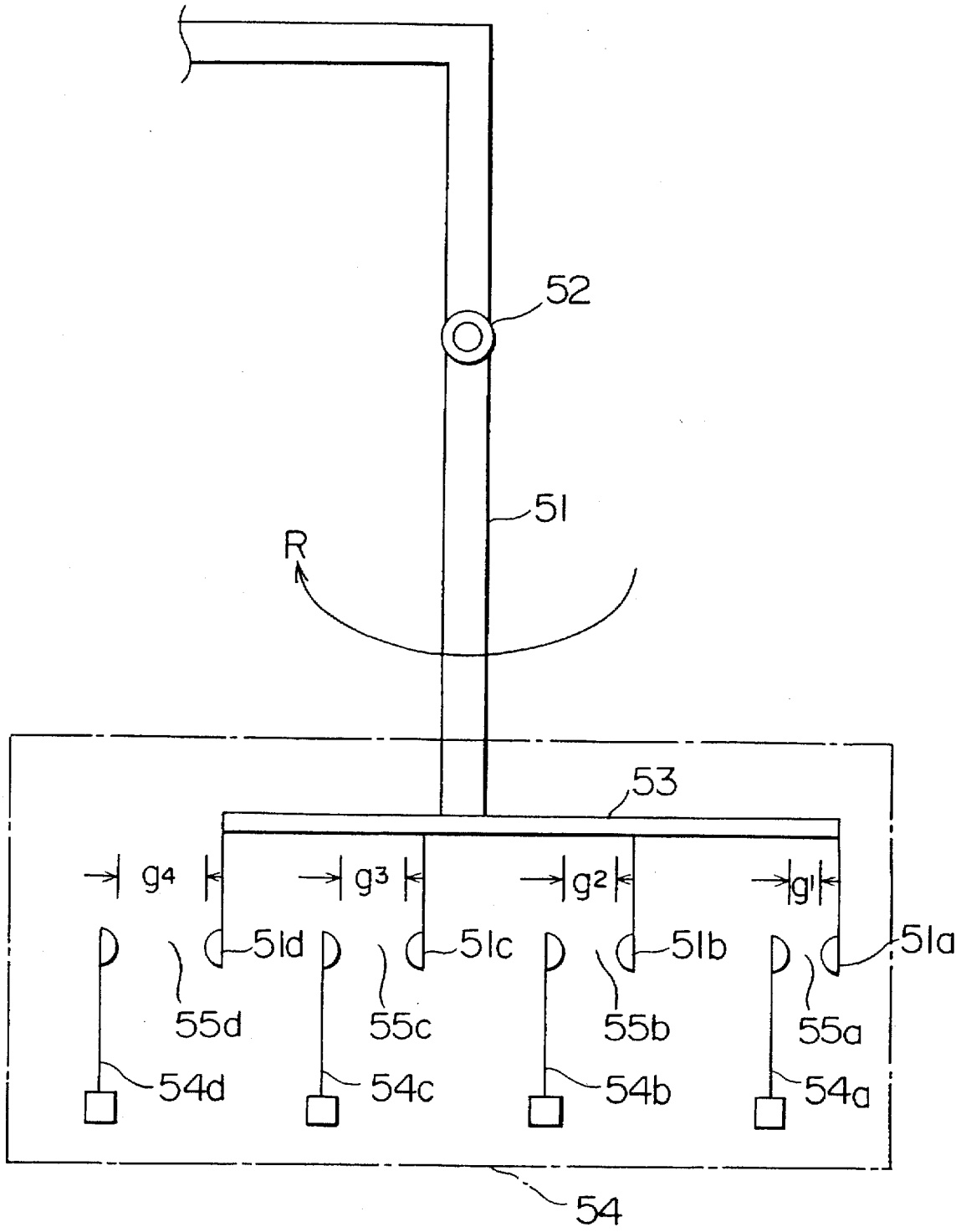
FIG. 5 illustrates in detail components contained in the switch box shown in FIG. 4.

FIG. 1 illustrates an embodiment of the present invention. Components the same as or comparable to those shown in FIG. 4 are denoted by the same numerals and will not be described again. Horizontal arms 62*a* to 62*e* are projected from the path wall 1 near the top terminal floor. The arm 62*a* is disposed at the lowest position, and the arm 62*e* at the uppermost position. All the arms 62*a* to 62*e* have substantially the same lengths. The arms 62*a* to 62*e* have top plates 9*a*–9*c*, 10*a*–10*c*, 11*a*–11*c*, 12*a*–12*c* and 13*a*–13*c*, respectively, which are substantially perpendicular to a plane of the sheet. The top plates 9*a* to 9*c* connected to the lowest arm 62*a* encode the first top operation point. A plurality of top operation points are arranged along the path of the car 6. The top plates 10*a* to 10*c* connected to the second lowest arm 62*b* encode the second top operation point. In the same manner, the top plates 11*a*–11*c*, 12*a*–12*c* and 13*a*–13*c* encode the third, fourth and fifth top operation positions, respectively.

Because the three top plates on one arm differ from the three top plates on another arm in horizontal arrangement (or positions), each top operation point is distinguishable from the other top operation points.

Naturally, this elevator car position detecting apparatus further comprises bottom plates and other components provided near the bottom terminal floor. Their arrangements and functions should be easily understood with reference to the above description and will not be described herein.

A position detector unit 6 (described later) is attached to a mount table 7 and comprises magnetic position detectors 8*a* to 8*f*. The position detectors 8*a* to 8*e* have approximately "U"-shapes having recesses. If the recesses of the position detectors receive top (or bottom) plates, the magnetism therein is blocked, thus turning off the position detectors.

Figure 2:
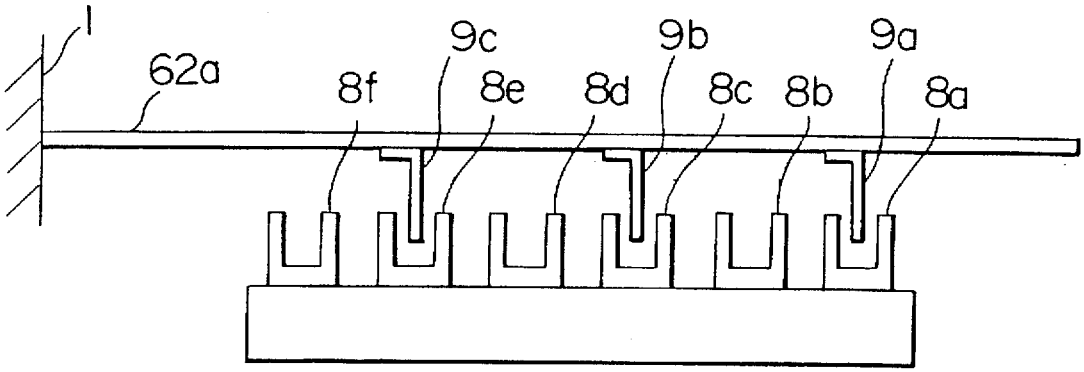
FIG. 2 is a plan of the elevator car position detecting apparatus shown in FIG. 1, illustrating the operation thereof.
Figure 3:
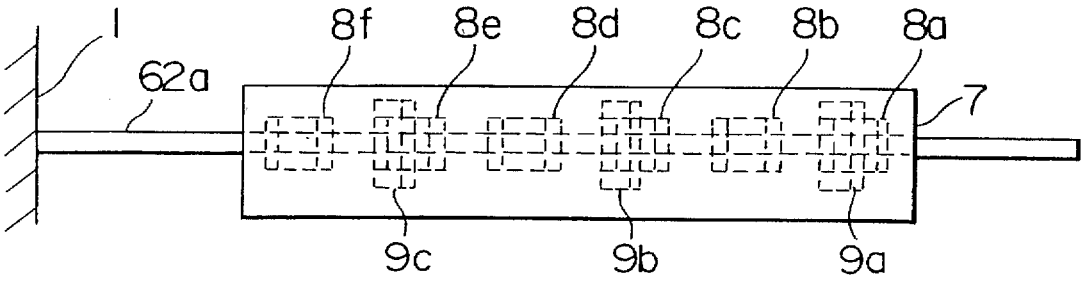
FIG. 3 is a front elevation of the apparatus shown in FIG. 2.

The operation of this embodiment of the present invention will be described hereinafter with reference to FIGS. 1, 2 and 3. When the position detectors 8*a* to 8*f* reach the first top operation point during ascent of the car 6 toward the top terminal floor, the top plates 9*a* to 9*c* relatively enter the corresponding position detectors (8*a*, 8*c* and 8*e* in FIGS. 3) and thus block the magnetism therein, turning off the detectors. The signals thus generated are sent to a control unit (not shown) to inform that the car 6 has reached the first top operation point. When the car 6 further ascends and the position detectors 8*a* to 8*f* reach the second top operation point, the top plates 10*a* to 10*c* relatively enter the corresponding position detectors (8*a*, 8*c* and 8*f* in this embodiment), and thus block the magnetism therein, turning off the position detectors. Thereby, the control unit is informed that the car 6 has reached the second top operation point.

As the car 6 further ascends, the top plates 11*a*–11*c*, 12*a*–12*c* and 13*a*–13*c* provided at the third, fourth and fifth operation points sequentially pass through the corresponding position detectors (8*a*, 8*d*, 8*e*), (8*a*, 8*d*, 8*f*) and (8*a*, 8*e*, 8*f*), respectively, blocking the magnetism therein, that is, turning off the position detectors. Thus, the control unit receives signals from the position detector unit as the car 6 passes the individual operation points.

Because the position detector unit comprising the position detectors 8*a* to 8*e* detects the position of the car 6 on the basis of the arrangement of each group of top plates 9*a*–9*c*, 10*a*–10*c*, 11*a*–11*c*, 12*a*–12*c* and 13*a*–13*c* arranged distinguishably from the other groups, the operation points where the position detector unit performs detection will remain in the same positions despite aging. Further, because the position detectors do not contact the top (or bottom) plates, the association of the position detectors with the plates causes no noise.

Position detection is performed in substantially the same manner when the car 6 is near the bottom terminal floor, and will not be described herein.

Although this embodiment utilizes magnetic effects, photoelectric effects may be utilized according to the present invention. More specifically, photoelectric detector means may be employed instead.

According to the present invention, because an elevator car position detecting apparatus comprises: a plurality of plates provided at each of operation points in such arrangement that one operation point is distinguishable from another operation point; and a position detector which is provided on a car and which is associable with the corresponding plates without contacting the plates and generates a signal indicating that the car has reached one of the operation points when associated with one of the plates, the apparatus achieves accurate and precise detection of the position of an elevator car, facilitates installation, and achieves quiet operation.

What is claimed is:

1. An elevator car position detecting apparatus for detecting the position of an elevator car along an elevator shaft, said elevator car position detecting apparatus comprising:

at least first and second operating devices provided on a side wall of the elevator shaft, each operating device provided at an operation position defined along the elevator shaft, each of said at least first and second operating devices including a plurality of operating elements disposed in a row in a direction perpendicular to the direction of travel of the elevator car in such positions that the operation positions can be encoded by using two or more ON/OFF signals, the plurality of operating elements of said first operating device being arranged such that at least one of the operating elements is misaligned with at least one of the operating elements of said second operating device along the direction of travel of the elevator car; and a detecting device provided on said elevator car, said detecting device including a plurality of detecting elements provided corresponding to said operating elements so that, when said elevator car is at any one of said operation positions, some of said detecting elements are operated by the corresponding operating elements and thereby generate a signal coding the position of said elevator car wherein the operating elements of said operating devices are shielding plates, and wherein each of said detecting elements of said detecting device comprises a transmitter portion and a receiver portion which can be shielded from each other by one of the shielding plates.

2. An elevator car position detecting apparatus for detecting the position of an elevator car along an elevator shaft, said elevator car position detecting apparatus comprising:

at least first and second operating devices provided on a side wall of the elevator shaft, each operating device provided at an operation position defined along the elevator shaft, each of said at least first and second operating devices including a plurality of operating elements disposed in a row in a direction perpendicular to the direction of travel of the elevator car in such positions that the operation positions can be encoded by using two or more ON/OFF signals, the plurality of operating elements of said first operating device being arranged such that at least one of the operating elements is misaligned with at least one of the operating elements of said second operating device along the direction of travel of the elevator car; and a detecting device provided on said elevator car, said detecting device including a plurality of detecting elements provided corresponding to said operating elements so that, when said elevator car is at any one of said operation positions, some of said detecting elements are operated by the corresponding operating elements and thereby generate a signal coding the position of said elevator car wherein the operating elements include magnetic shielding plates, and wherein said detecting elements include magnetic detecting elements.

3. An elevator car position detecting apparatus for detecting the position of an elevator car along an elevator shaft, said elevator car position detecting apparatus comprising:

at least first and second operating devices provided on a side wall of the elevator shaft, each operating device provided at an operation position defined along the elevator shaft, each of said at least first and second operating devices including a plurality of operating elements disposed in a row in a direction perpendicular to the direction of travel of the elevator car in such positions that the operation positions can be encoded by using two or more ON/OFF signals, the plurality of operating elements of said first operating device being arranged such that at least one of the operating elements is misaligned with at least one of the operating elements of said second operating device along the direction of travel of the elevator car; and a detecting device provided on said elevator car, said detecting device including a plurality of detecting elements provided corresponding to said operating elements so that, when said elevator car is at any one of said operation positions, some of said detecting elements are operated by the corresponding operating elements and thereby generate a signal coding the position of said elevator car wherein said operating elements include optical shielding plates, and wherein said detecting elements include photoelectric converting elements.

* * * * *